United States Patent [19]

Choinski

[11] 4,113,903

[45] Sep. 12, 1978

[54] METHOD OF MULTILAYER COATING

[75] Inventor: Edward J. Choinski, Wayland, Mass.

[73] Assignee: Polaroid Corporation, Cambridge, Mass.

[21] Appl. No.: 801,144

[22] Filed: May 27, 1977

[51] Int. Cl.[2] ..... B05D 1/30

[52] U.S. Cl. ..... 427/420; 96/87 R; 96/85; 118/410; 118/411; 427/348

[58] Field of Search ..... 427/348, 420, 445; 118/324, 410, 411; 96/87 R, 85

[56] References Cited

U.S. PATENT DOCUMENTS

| | | | |
|---|---|---|---|
| 2,761,417 | 9/1956 | Russell et al. | 118/410 |
| 3,413,143 | 11/1968 | Cameron et al. | 118/411 X |
| 3,502,494 | 3/1970 | Ishiwata et al. | 118/411 X |
| 3,526,528 | 9/1970 | Takahashi et al. | 118/411 X |
| 3,916,043 | 10/1975 | Fowble | 96/87 R X |
| 3,920,862 | 11/1975 | Damschroder et al. | 96/87 R X |
| 3,928,678 | 12/1975 | Jackson | 96/87 R X |
| 3,928,679 | 12/1975 | Jackson et al. | 96/87 R X |
| 3,993,019 | 11/1976 | Jackson et al. | 118/411 X |
| 3,996,885 | 12/1976 | Jackson et al. | 118/411 X |
| 4,001,024 | 1/1977 | Dittman et al. | 427/420 X |

FOREIGN PATENT DOCUMENTS

| | | | |
|---|---|---|---|
| 727,567 | 2/1966 | Canada | 427/420 |

*Primary Examiner*—Shrive P. Beck
*Attorney, Agent, or Firm*—John W. Ericson

[57] ABSTRACT

A method of multilayer coating in which a multilayer laminar bead of discrete fluids is coated on a moving web, and in which the layer adjacent the web has a substantially higher viscosity in the bead than at the point of contact with the web.

6 Claims, 3 Drawing Figures

METHOD OF MULTILAYER COATING

This invention relates to multilayer coating, and particularly to a novel method for the high speed application of a plurality of layers of fluid compositions to a moving web of sheet material.

The art of multilayer coating has been highly developed, particularly in connection with the manufacture of photographic sheet materials comprising many thin laminar strata of different compositions on a base sheet. These compositions are commonly diluted with a fugitive vehicle, such as water or an organic solvent, and coated simultaneously, as with a multiple channel bead coater, curtain coater, extrusion coater or the like. This coating operation is followed by a drying process in which the coating vehicle is removed.

The speed and efficiency with which multiply coated sheet materials can be produced depend directly on the web speed that can be attained. For given coating conditions, the web speed determines the drying rate in terms of the amount of coating vehicle that must be removed from the coated product per unit of time. Since drying temperatures are usually limited by the nature of the product, a higher drying rate implies not only a higher drying load, but a larger plant. From this point of view, it is desirable to limit the amounts of coating vehicle used in the coating compositions. On the other hand, the usual functions of the vehicle are to reduce the viscosity of the coating composition to enable higher web speeds to be attained, and to produce thinner layers in the final product, without dicontinuities in the product. The first layer, that is, the layer next to the web, is also required to wet the web, which usually requires considerably more of the coating vehicle than would otherwise be desirable.

One approach to the problem of increasing web speed without increasing the drying load or the incidence of web defects is described in U.S. Pat. No. 4,001,024, and references therein cited. The basic premise is that uniform coatings of multiple layers can be attained at higher web speeds if the viscosities of the layers are progressively lower toward the web. In particular, U.S. Pat. No. 4,001,024 recommends that the layer next to the web be formulated to have a very low viscosity; i.e., from 1 to 8 cps, with the second layer at a much higher viscosity; i.e., from 10 to 100 cps. Mixing between the first and second layers is contemplated; the first layer is made quite thin, and has a composition that is either a diluted version of the composition of the second layer, or at least will not interfere with the second layer.

One problem with the use of a very low viscosity first layer in multilayer coating is that a low viscosity layer tends to be unstable, particularly in the bridge between coater lip and web in the bead formed with a bead coater. Up to a point, this instability can be prevented by the application of vacuum behind the bead, but it can still be the limiting factor in determining web speed. Another consideration is that interlayer mixing is not particularly desirable, in that it puts another limitation on the choice of layer compositions.

The object of this invention is to facilitate the application of multiple uniform coatings to a web at high web speeds without increasing the drying load. Briefly, this and other objects of the invention are attained by a multilayer bead coating process in which the first layer, that is, the layer next to the web to be coated, is a non-Newtonian, pseudoplastic liquid having a high viscosity under low shear conditions, and a low viscosity under high shear conditions. The fluid properties of the second and any subsequent layers are not critical, and may be chosen on the basis of conventional considerations. The use of a variable viscosity first layer in this fashion produces a mechanically strong bridge in the coating bead, promotes wetting of the web, and allows the use of a relatively high viscosity second layer including a high content of solids, and thus smaller amounts of vehicle that must be removed by drying.

The manner in which it is preferred to practice the invention will best be understood in the light of the following description, together with the accompanying drawings.

While it will be apparent to those skilled in the art that the invention may be practiced in the production of a variety of multiply coated products, for clarity and conciseness of exposition it will be described in its relation to the production of photographic films and paper. In general, these comprise a base of paper or plastic, such as cellulose acetate or polyethylene terephthalate, coated with a plurality of distinct layers containing the various photosensitive and other constituents of an image forming system. Such coatings are conventionally applied as aqueous solutions or dispersions, in which water is included in amounts chosen to facilitate coating to the desired dry weight and at the desired coating speed. Since the water must later be removed by drying, it is obviously desirable to use as little as possible.

Figure 1:
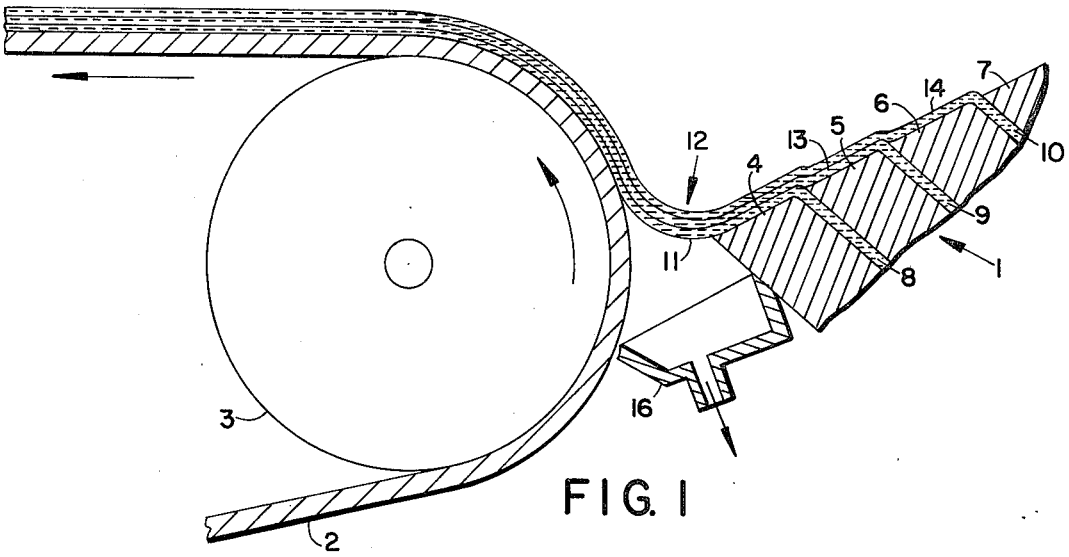
FIG. 1 is a schematic and fragmentary elevational sketch, with parts omitted, parts shown in cross-section, and parts broken away, of a bead coater useful in the practice of the invention.

FIG. 1 shows a bead coater of the kind commonly used in multiple layer coating. The apparatus comprises a cascade slide applicator generally designated 1 mounted adjacent a web 2 moving in the sense shown by the arrow over a driven roll 3.

The applicator 1 comprises a series of slides such as 4, 5, 6 and 7 between which are coating slots such as 8, 9 and 10. The coating slots 8, 9 and 10 extend transversely over a distance corresponding to the width of the web 2.

A lowermost layer 11 of coating liquid is pumped into the coating slot 8 by conventional means, not shown, and flows downward over the lowermost slide 4 into a bead generally designated 12 and thence onto the surface of the web 2. Similarly, a second layer of liquid 13 is pumped to the slot 9, and flows therefrom downwardly over the slide 5, and thence over the surface of the layer 11, through the bead region 12 and over the layer 11 on the web 2. A third layer of liquid 14 is shown supplied from the slot 10, and other layers could obviously be supplied from additional slots, not shown. As indicated, a conventional vacuum box 16 may be provided to produce a low pressure behind the bead 12 to stabilize the bead in a known manner.

Figure 2:
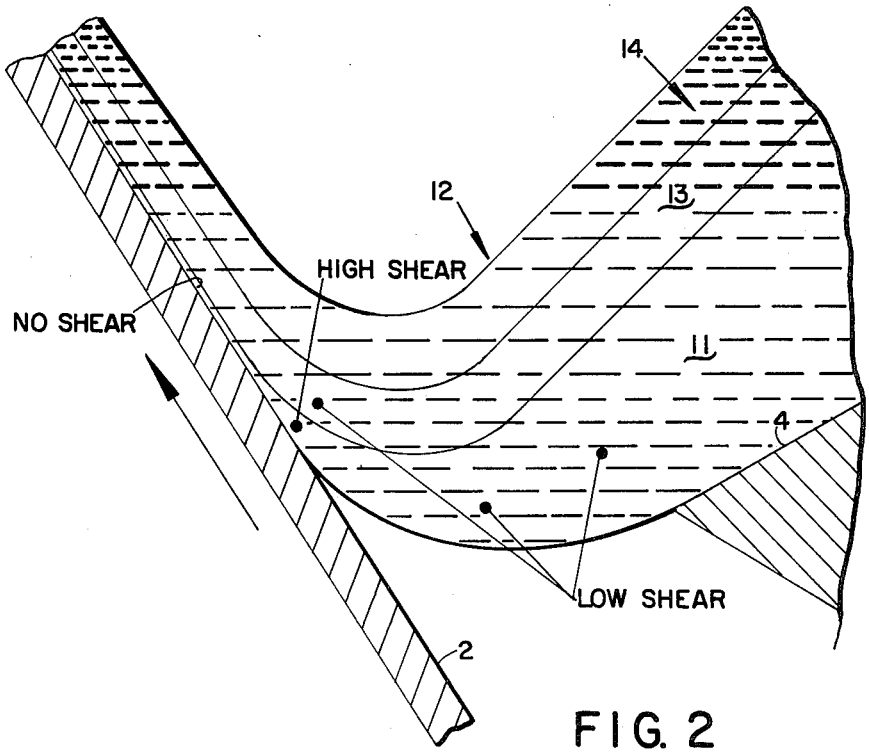
FIG. 2 is a fragmentary schematic view, on an enlarged scale, showing details of the multilayer bead formed in coating with the apparatus of FIG. 1.

As shown in FIG. 2, the liquid layers 11, 13 and 14 undergo a radical change in direction in the bead region 12, and are thinned as they are drawn down onto the web 2. The first layer 11 experiences most of the drawdown, and the highest shear rates occur in the lower portion of the layer 11 just adjacent the point of dynamic wetting on the web. It is generally desirable that the final layers on the web be of uniform thickness and that they retain their distinct characteristics with little or no mixing between layers.

The compositions of the upper layers such as 13 and 14 may be chosen on the basis of conventional considerations based on their ultimate purposes in the finished product and the desired final coating weight. For photographic purposes, typical compositions are aqueous systems including silver halide emulsions, protective gelatin coatings, dyes or dye precursors, antifoggants, thickeners, sensitizers, bacteriostats and the like which are designed to function together as an image forming system when dried and superposed in distinct layers of precisely determined thickness. It is usually necessary to include water in these compositions to reduce their viscosities, for example, to 20 to 200 centipoises, and thereby make them coatable at desired web speeds, but it is highly undesirable to use more water than absolutely necessary. These compositions, when coated on the second or subsequent layers, are typically coated at viscosities of 50 to 300 centipoises. In addition to the drying load imposed with added water, solutions or dispersions with very low viscosities are more prone to instability in the bead, which causes coating defects, and to undesired interlayer mixing.

The liquid layer 11 next to the web may have a composition chosen to perform a photographic function in the image forming system, but is preferably a very thin carrier layer whose sole function is to improve the coatability of the supervening layers, and thus open up the options on the compositions of those layers. A very important aspect of this improvement is that it permits the total amount of water in the second layer 13 to be reduced, thus reducing the drying load. Another practical advantage is that the coating gap, i.e., the distance between the lip of the applicator and the web 2 across which the bead 12 is formed, can be increased significantly. This result allows the coating system to be much more tolerant to such matters as particulates in the coating fluids or splices in the web.

The composition of the layer 11 is not critical, but it is essential for the layer to exhibit a high degree of shear thinning. In particular, it is very desirable to have a high viscosity, e.g., from 20 to 200 centipoises at 42° C., on the slide 4 and in the regions of the bead 12. This high viscosity increases bead stability and makes it possible to use a higher bead vacuum; for example, up to 10 inches of water, to further stabilize the bead. From other points of view, the high viscosity at low shear rates makes it possible to open up the coating gap, and to stabilize the bead at the same web speed. Again, when the liquid has come to rest relative to the web after it has been coated and before it has set and/or been dried on the web, a high viscosity is desirable to prevent runback on the web. However, at the point of dynamic wetting where the fluid first contacts the web, a low viscosity, i.e., less than 10 centipoises and preferably less than 5 centipoises at 42° C., is desirable to promote wetting of the web. These properties can be incorporated in the same liquid if the liquid is an appropriately chosen pseudoplastic material.

Many photographic compositions are pseudoplastic, or shear thinning, to some degree; for example, aqueous gelatin solutions have this property. However, a sufficiently concentrated gelatin solution would have too high a viscosity, both under low shear and high shear conditions, to be useful in the practice of the invention. As a practical matter, it is preferred to formulate the composition for the layer 11 by adjusting the viscosity of a low viscosity solvent with a shear thinning thickening agent. The thickening agent is generally a polymeric material that is soluble in the chosen solvent and imparts a strongly shear thinning property to the solution.

For photographic purposes, water is the preferred solvent. Thus, the thickening agent would be chosen from those water soluble polymers that produce the desired pseudoplastic characteristics, preferably a low concentrations of the polymer. One presently preferred thickening agent is sodium cellulose sulfate, which is effective in aqueous solution in concentrations of less than 0.5 percent by weight. As other thickening agents having the requisite shear thinning properties, and which are particularly suited for use in photographic systems, mention may be made of those described in U.S. Pat. Nos. 3,705,798 and 3,904,417; specifically, the other water soluble salts of cellulose; copolymers of methyl vinyl ether and maleic anhydride; water soluble salts of polyvinyl hydrogen phthalate; polystyrene sulfuric acid, sulfonated vinyltoluene polymers, and the like. Gelatin may be included if desired, but it has been found that a simple solution of water and the selected thickening agent is quite efficacious.

The amounts of the shear thinning thickening agent employed in the layer 11 are chosen to produce the desired low viscosity, of less than 10 centipoises, and preferably less than 5 centipoises, at shear rates in the high range of those to be encountered at the dynamic wetting point on the web, and a desirably high viscosity, from 20 to 200 centipoises, at low shear rates. The data required to determine the suitability of a given thickening agent can be determined by a few measurements with a rheometer, such as the Haake Rotovisco rheometer, at different shear rates and concentrations of the thickening agent in the chosen vehicle. As discussed in more detail in "Properties of Liquids" by Martin O. Wohl, on pages 11–18 of the Apr. 4, 1969 Deskbook Issue of *Chemical Engineering,* the behavior of a pseudoplastic material can be represented by a straight line on a logarithmic plot of viscosity versus shear rate. Specifically, pseudoplastic behavior may be described by:

$$\eta = m\,(d\gamma/d\tau)^{n-1}$$

where $\eta$ is viscosity in centipoise, $d\gamma/d\tau$ is shear rate in $sec^{-1}$ $m$ is the consistency, equal to the viscosity of the fluid at a shear rate of 1 (one) reciprocal second, and $n$ is the flow behavior index.

For Newtonian fluids, $n = 1$ in the above equation. For pseudoplastics, however, $n$ is a number which is less than 1.

Figure 3:
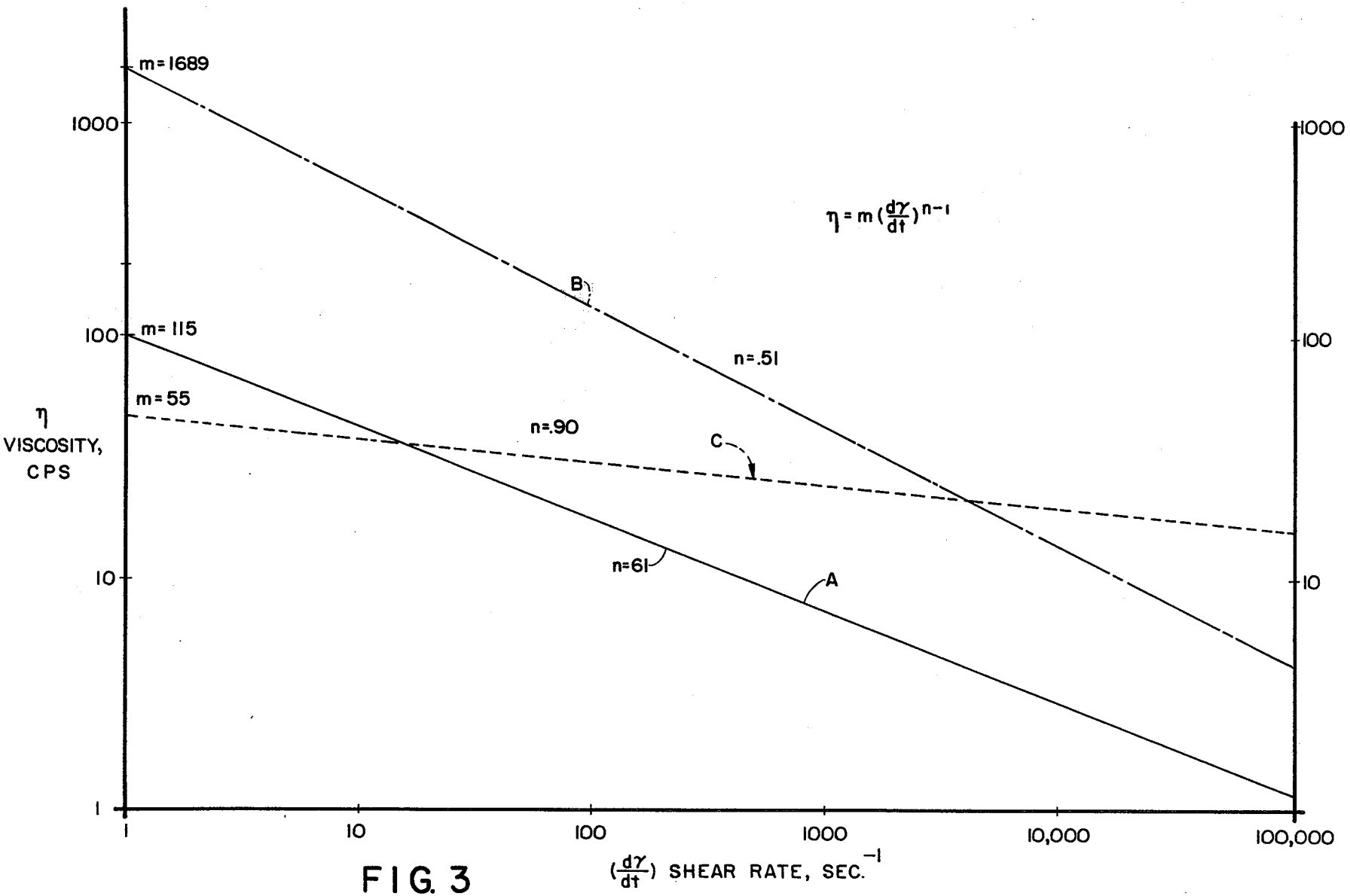
FIG. 3 is a graph of viscosity versus shear rate for various coating compositions useful in the practice of the invention.

On a logarithmic plot of the above equation, $m$ is the value of $\eta$ at a shear rate of one $sec^{-1}$, and $(n-1)$ is the slope of the line. FIG. 3 is such a graph of $\eta$ versus $d\gamma/d\tau$ for three fluids, two which are suitable for use as the carrier layer 11, and one which is not.

The graphs of FIG. 3 were made with data taken with a Haake Rotovisco rheometer at 42° C. and at shear rates in the range from about 100 $sec^{-1}$ to 37,000 $sec^{-1}$, and extrapolated therefrom in both directions. Shear rates of interest at and in the immediate vicinity of the dynamic wetting point on the web at coating speeds on the order of 100 cm/sec run from about 10,000 $sec^{-1}$ to over 100,000 $sec^{-1}$. In order to obtain the advantages of the invention, the viscosity of the liquid in the layer 11 should be below 10 centipoises through at least the upper portion of this range, and preferably below 5 centipoises throughout the range.

Line A in FIG. 3 represents a presently preferred carrier layer composition comprising an aqueous solution containing water and 0.43 percent of sodium cellulose sulfate by weight of solution. This solution has a consistency $m$ of 115, and the slope $(n-1)$ of the line gives $n=0.61$ in the above equation. As shown in FIG. 3, the viscosity is 3 or less throughout the shear rate range of interest. Good results have also been obtained with a solution containing 0.43 percent sodium cellulose sulfate, 2.0 percent gelatin, and the balance water by weight of solution. However, in this concentration the gelatin does not appear to have any appreciable effect on the shear thinning ability of the liquid, so that it would not be included in the preferred practice of the invention unless its presence was desired for some other reason.

Line B in FIG. 3 represents a 2 percent aqueous solution of gelatin which has been thickened with 0.2 percent polyvinyl hydrogen phthalate (PVHP) by weight of solution, and the balance water. This solution has a consistency m=1689 and n=0.51. The viscosity of this solution is below 10 cps at shear rates above 30,000 $sec^{-1}$, and thus is useful in the practice of the invention.

Line C in FIG. 3 represents a 4 percent aqueous solution of polyvinyl alcohol by weight of solution. It has a consistency $m$ of 55.4, with $n=0.9$. While this fluid is somewhat shear thinning, it is not sufficiently so to serve the purpose of the invention, especially at higher coating speeds.

The values of $m$ and $n$ in the above equation are obviously better descriptors of a pseudoplastic than the usual viscosity values given for Newtonian or nearly Newtonian liquids. For purposes of comparison, however, it is noted that capillary viscometers usually measure viscosity at shear rates from 100 to 200 $sec^{-1}$, Brookfield viscometers from 50 to 100 $sec^{-1}$, and rolling ball viscometers at around 1,200 $sec^{-1}$. Thus, the liquid of curve A in FIG. 3 would have a viscosity of 18 to 24 centipoises at 42° C. as measured on a Brookfield viscometer.

Carrier layer compositions in accordance with the invention are effective in thin layers; e.g., at coating weights of from $0.1^{cm^3}/ft^2$ to $1^{cm^3}/ft^2$ ($1.08^{cm^3}/m^2$ to $10.8^{cm^3}/m^2$).

While the invention has been described with reference to the details of specific illustrative embodiments, many changes and variations will be apparent to those skilled in the art upon reading this description. Such can obviously be made without departing from the scope of the invention.

What is claimed is:

1. In the process of applying a multilayer liquid coating to a moving web as distinct superposed continuous layers that are thinned as they are drawn down on the web, the improvement which comprises applying as the layer next to the web a shear thinning carrier layer of pseudoplastic liquid having a viscosity between 20 and 200 centipoises at a shear rate of 100 $sec^{-1}$ and a viscosity below 10 centipoises at a shear rate of 100,000 $sec^{-1}$.

2. The process of claim 1, in which the viscosity of said carrier layer is below 5 centipoises at a shear rate of 10,000 $sec^{-1}$.

3. The process of claim 1, in which said carrier layer comprises an aqueous solution of a shear thinning thickening agent.

4. The process of claim 3, in which said thickening agent is sodium cellulose sulfate.

5. The process of claim 3, in which said solution contains gelatin.

6. In the process of simultaneously applying a plurality of aqueous layers to a moving web as distinct superposed continuous layers that are thinned as they are drawn down on the web, the improvement which comprises applying as the first layer next to the web an aqueous pseudoplastic having a consistency $m>50$ and a flow behavior index $n<0.7$ and a viscosity substantially given by $$\eta = m\,(d\gamma/d\tau)^{n-1}$$

where $\eta$ is viscosity and $d\gamma/d\tau$ is the shear rate and $\eta$ is less than 5 centipoises at a shear rate of 100,000 $sec^{-1}$, and applying as the second layer next to said first layer a liquid containing at least 10 percent of solids by weight of solution and having a viscosity greater than 50 centipoises at 42° C. at a shear rate of 100 $sec^{-1}$.

* * * * *